United States Patent [19]

Rinker et al.

[11] Patent Number: 4,827,902

[45] Date of Patent: May 9, 1989

[54] FIREPLACE ENCLOSURE

[75] Inventors: Carl G. Rinker, Atwater; Robert E. Lyren, Akron; Ray M. Repasky, Poland, all of Ohio

[73] Assignee: Thermo-Rite Manufacturing Company, Akron, Ohio

[21] Appl. No.: 76,217

[22] Filed: Jul. 22, 1987

[51] Int. Cl.[4] ..... F24C 15/12

[52] U.S. Cl. ..... 126/548; 126/190; 126/549

[58] Field of Search ..... 126/138, 139, 121, 190, 126/198, 193, 200

[56] References Cited

U.S. PATENT DOCUMENTS

| | | | |
|---|---|---|---|
| 986,292 | 3/1911 | Hunter . | |
| 1,432,565 | 10/1922 | Malec . | |
| 2,644,191 | 7/1953 | Meyer | 126/202 X |
| 3,145,765 | 8/1964 | Spongberg et al. | 126/202 X |
| 3,260,257 | 7/1966 | Mason | 126/138 |
| 3,459,173 | 8/1969 | Lydle | 126/138 X |
| 3,605,719 | 9/1971 | Andrews | 126/139 |
| 4,086,906 | 5/1978 | Reichgut | 126/202 X |
| 4,231,349 | 11/1980 | Livesay | 126/139 |
| 4,512,330 | 4/1985 | Larkins | 126/139 |

*Primary Examiner*—Larry Jones

*Attorney, Agent, or Firm*—Michael Sand Co.

[57] ABSTRACT

A fireplace enclosure consisting of a rectangular-shaped frame formed by spaced pairs of top and bottom and side frame members clamped together by a pair of tie rods, whereby an opening is formed to provide access into the firebox of a fireplace. A pair of bifold doors are movably mounted on the frame for opening and closing the access opening. The doors each include a frame and a pair of safety glass panels held in channels formed in the frame by ribbon spring steel strips. The doors are pivotally removably mounted on spring clips attached to the top and bottom channel members for movement between open and closed positions. Low friction guide rollers are mounted on the door frames and slidably engage the top and bottom frame members and V-shaped spring clips attached thereto to assist in opening and closing the doors and to provide support for the doors. A draft diverter plate may be mounted on the bottom member of the frame to provide drafts to the firebox. A heavy gauge metal mesh curtain may be mounted on the top member of the frame to guard against sparks emitted from the firebox.

12 Claims, 4 Drawing Sheets

FIREPLACE ENCLOSURE

TECHNICAL FIELD

The invention relates to a fireplace enclosure and in particular to an improved fireplace enclosure having an extruded metal frame which is securely held together and supported by tie rods thereby making it possible to manufacture sturdy, attractive enclosures of various sizes in an efficient, economical manner.

BACKGROUND ART

The fireplace, a framed opening in a chimney which holds an open fire, has long been the focal point for indoor gatherings of family and friends. The primary benefits of an indoor fire are its beauty and warmth. However, an improperly maintained fireplace may present a fire hazard as well as allow large amounts of heat loss up the chimney in the winter and cool air loss in the summer. A well-constructed fireplace enclosure not only adds to the beauty and warmth of the room in which it is installed, but acts as a protective barrier for family, pets, and the interior of the home from the fire hazards associated with fireplaces. It can also assist in substantially decreasing heat and air loss up the chimney as well as eliminating smokey rooms and fireplaces.

Although fireplace enclosures have been manufactured for many years, the known prior art has several problems associated with it. Prior fireplace enclosures include a frame the various metal components of which are die stamped and then bent, folded and otherwise shaped and then connected together by numerous fasteners to form the desired structure. Such a process necessarily entails large amounts of time and high costs in order to achieve the desired result. Additionally, it is necessary to manufacture a separate stamping die for each component of the frame which is time consuming and expensive. Further, once the stamping dies are manufactured, they can be used to produce only one size of component for the enclosure frame. Therefore, if a different size fireplace enclosure is desired, new stamping dies must be made to those specifications even if the design of the enclosure is exactly the same. Also, the framed firebox openings in chimneys are as varied as the buildings in which they are installed. Therefore, in order to serve a wide range of customers, a company is forced to manufacture stamping dies of many sizes for a single enclosure model, multiplied by the number of models in a company's product line. Such practices are inefficient and expensive.

Many of the known prior art fireplace enclosures also lack the structural rigidity that is required to provide a safe and efficient enclosure. Another problem in prior enclosures is the lack of a device that securely retains a glass panel in the fireplace door frame while at the same time facilitating easy installation of the glass in the frame at the assembly plant. Further, many prior fireplace enclosures have doors that are easily opened by small children and that after a period of time will sag, that are difficult to clean and repair because they are permanently mounted on the enclosure frame, and that do not glide easily along their tracks when opened and closed. Finally, many fireplace enclosures have unnecessary equipment such as separate draft diverters which increase the cost of the unit while adding little to its functionality.

There is no prior art fireplace enclosure of which we are aware which provides as safe, sturdy, energy efficient and aesthetically pleasing enclosure as that of our invention, and which can be produced in a cost-effective manner for a wide range of sizes to match the variety of firebox opening sizes.

DISCLOSURE OF THE INVENTION

Objectives of the invention include providing an improved fireplace enclosure having a main outer frame and individual door frames made of an extruded metal, thereby eliminating expensive stamping dies and the time consuming bending, folding and assembling of the die stamped components into the desired frame shape. Another objective is to provide such an improved enclosure in which the main frame components and door frame channels of the enclosure are die extruded requiring only a small number of extrusion dies for the manufacture of enclosures of various sizes and designs simply by cutting the extruded metal members to specified lengths.

A still further objective of the invention is to provide such an improved fireplace enclosure in which the main frame of the enclosure is held together by tie rods to provide a rigid frame structure without additional attachment bolts or fasteners.

Still another objective of the invention is to provide such an improved fireplace enclosure in which the door glass panels are firmly retained in the door channels or frames by spring steel glass retaining strips which greatly facilitate the installation of the glass in the door frames at an assembly plant. Another objective is to provide such a construction in which the doors of the enclosure are removably mounted on the main frame by spring clips for easy assembly, disassembly, cleaning and repair.

A still further objective of the invention is to provide such an improved fireplace enclosure having doors which close beyond center for rigidity and safety and which utilizes tempered glass for aesthetic, heat radiation and safety purposes.

Still another objective of the invention is to provide such an improved fireplace enclosure in which guide rollers made of a low friction material slidably mount the doors on the main enclosure frame for ease in slidably opening and closing the doors. Another objective is to provide an enclosure in which the guide rollers assist in securing the doors in the closed position by cooperating with V-shaped spring clips, and which also assist in supporting the doors by cooperating with a horizontal bottom frame member of the enclosure to eliminate sag A further objective of the invention is to provide such an improved fireplace enclosure in which a draft diverter plate may be mounted on the horizontal bottom frame member of the enclosure by inexpensive fasteners for certain enclosures, whereas for other enclosures the mounting of the doors in a spaced relation from the bottom horizontal member of the frame allows adequate drafts to reach the fire thereby eliminating the need for such a separate diverter; and in which the draft diverter plate may be either mounted on or excluded from the enclosure without appreciably affecting the appearance or functionality of the enclosure.

Another objective of the invention is to provide such an improved fireplace enclosure in which the extruded metal of the frame and door frame channels is anodized to provide a variety of decorative and mar resistant finishes compatible with the decor and decorating taste of the homeowner.

A still further objective of the invention is to provide such an improved fireplace enclosure in which heavy gauge metal mesh curtains may be quickly and easily removably mounted on a horizontal top frame member of the enclosure by inexpensive, sturdy mounting means to guard against sparks which are emitted from the firebox of a fireplace when the doors of the enclosure are in the open position; and in which the mesh curtains may be either mounted on or excluded from the enclosure without affecting the appearance or functionality of the enclosure.

These objectives and advantages are achieved by the improved fireplace enclosure of the invention, the general nature of which may be stated as including a generally rectangular frame formed by a pair of spaced horizontal top and bottom members and a pair of spaced vertical side members providing an opening therebetween for access into the fireplace; door means movably mounted on the frame for opening nd closing the frame opening; and rod means extending between certain of the frame members for securing together said frame members to form the frame.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figures 1, 2:
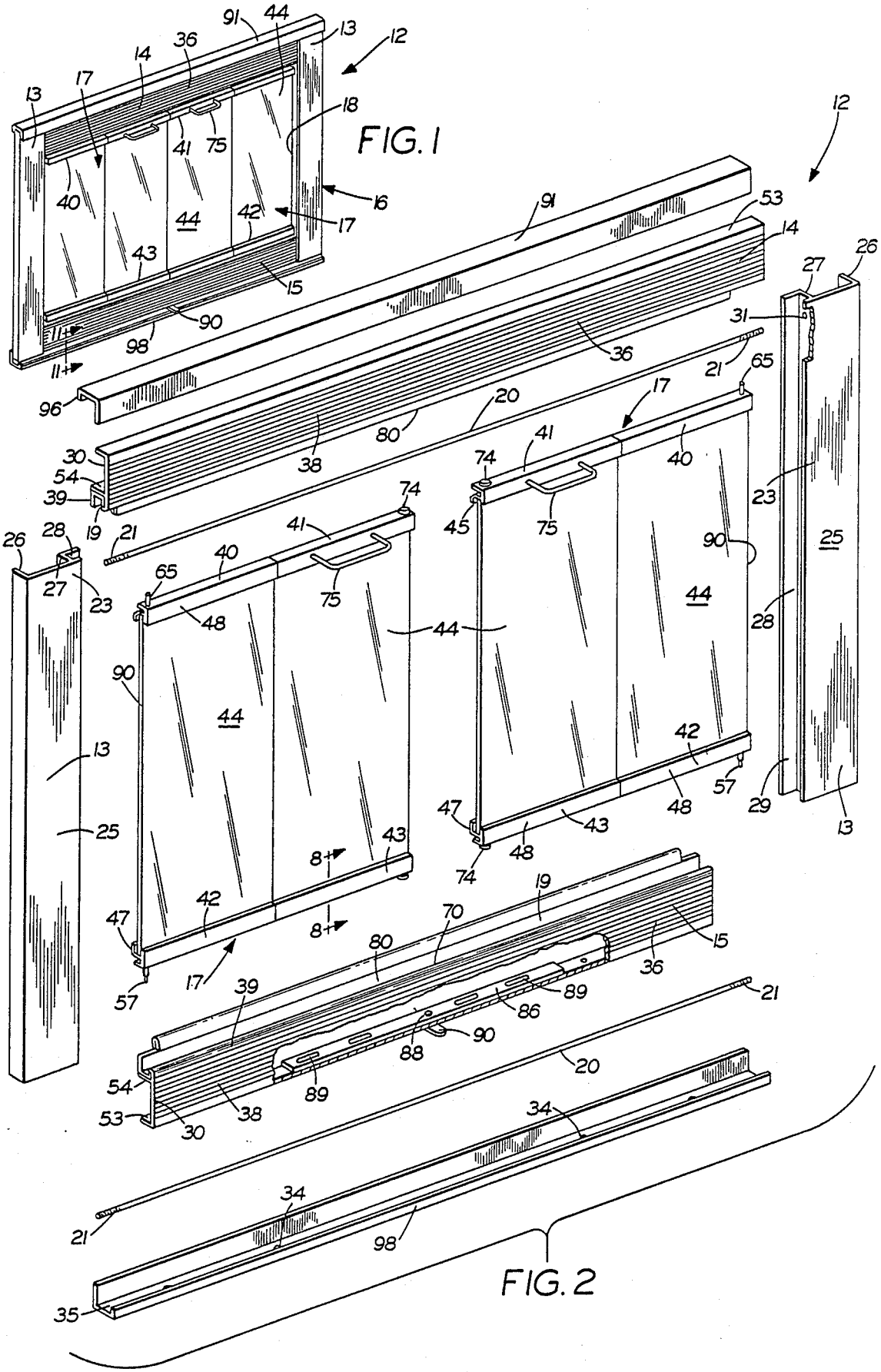
FIG. 1 is a front perspective view of the improved fireplace enclosure.
FIG. 2 is an enlarged exploded perspective view of the major components of the fireplace enclosure with portions broken away and in section.

The improved fireplace enclosure of the present invention is indicated generally at 12, and is shown particularly in FIGS. 1 and 2. Enclosure 12 consists of a pair of spaced parallel vertical side frame members 13 and a horizontal top frame member 14 which is mounted in a parallel spaced relationship to a horizontal bottom frame member 15. Members 13, 14 and 15 form a generally rectangular main frame, indicated generally at 16, and define a rectangular-shaped opening 18 which provides access into the firebox of a fireplace. A pair of identical bifold doors, each indicated generally at 17, are pivotally slidably mounted on frame 16 and extend between frame members 13, 14 and 15 and are movable between open and closed positions for opening and closing frame opening 18 to provide access into the firebox and to prevent heat loss and to prevent sparks from leaving the firebox.

In accordance with one of the main features of the invention, a pair of tie rods 20 (FIGS. 2–4) extend between vertical side frame members 13, clamping the side members against the top and bottom frame members to form main frame 16 into a sturdy structure without requiring any additional fastening brackets, bolts, screws, etc. Tie rods 20 preferably are cylindrical metal rods having threaded ends 21 and are located parallel to and adjacent the rear of frame members 14 and 15.

Side frame members 13 (FIG. 2), which are identical to each other and perform the same functions, each have a generally U-shaped configuration including a web wall 25 and two rearwardly facing side walls 26 and 27. Side wall 27 also functions as a web wall for an inwardly facing U-shaped channel 29 of the side members, with an inward extension of web wall 25 acting as one side wall 23 thereof together with a spaced parallel side wall 28.

Outside edges 30 (FIG. 2) of top and bottom frame members 14 and 15 nest in channel 29 of side frame members 13 (FIGS. 3, 4, and 7) when the top and bottom frame members are clamped therebetween by tie rods 20. Threaded ends 21 of tie rods 20 extend through holes 31 formed in channel wall 27 of the side frame members and through aligned holes formed in a pair of spacers 32. Nuts 33 engage threaded ends 21 of the tie rods and clamp spacers 32 against walls 27, which in turn, are clamped against outside edges 30 of frame members 14 and 15 to form main frame 16 into a sturdy structural member Additionally, main frame members 13, 14 and 15 are formed of extruded metal and may be cut to any specified length thereby facilitating the construction of frame 16 of various sizes.

Figures 3, 4, 5, 6:
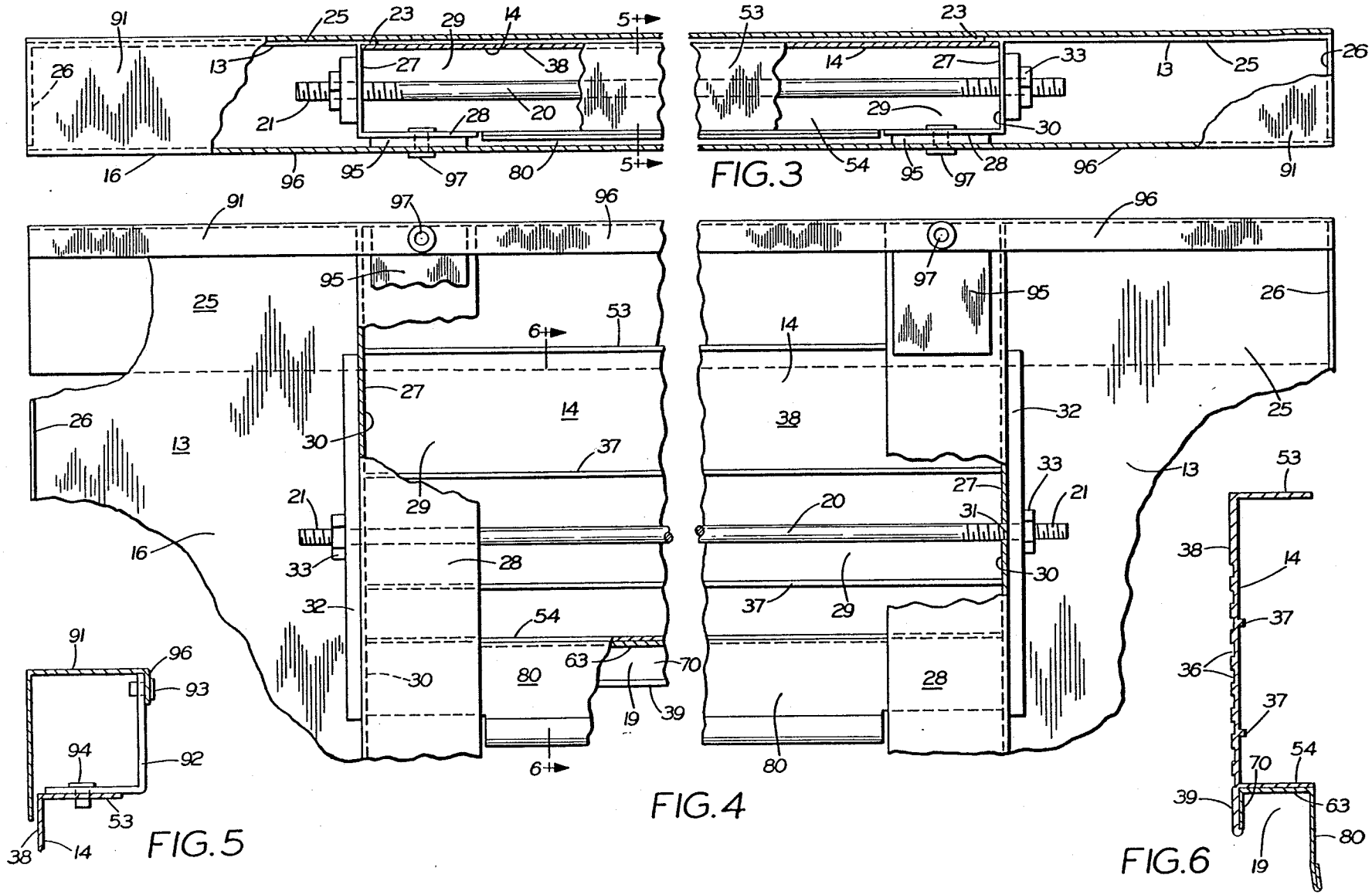
FIG. 3 is an enlarged fragmentary top plan view of the enclosure with portions broken away and in section, with the doors removed, particularly showing the tie rod assembly.
FIG. 4 is an enlarged fragmentary rear elevational view f the enclosure with portions broken away and in section, with the doors removed.
FIG. 5 is a sectional view taken on line 5—5, FIG. 3, showing the engagement of the support bracket with the decorative strip and the horizontal top frame member.
FIG. 6 is a sectional view taken on line 6—6, FIG. 4, showing the horizontal top frame member.

Horizontal frame members 14 and 15, which are identical to each other and perform substantially the same functions, each have a generally U-shaped configuration including a web wall 38 and two rearwardly facing side walls 53 and 54 (FIGS. 2 and 6). The lower portion of top member 14 and the upper portion of bottom member 15 each includes another generally U-shaped channel 19 formed by a web wall 63, and two spaced parallel side walls 70 and 80. Web wall 63 and side wall 70 are welded to and coincide with sidewall 54 and an extension 39 of web wall 38, respectively (FIG. 6). Web wall 63 and side walls 70 and 80 are formed of a lightweight, sturdy aluminum, with the other portions of frame members 14 and 15 being formed of a heavier aluminum. U-shaped channel 19 faces downward on top frame member 14 and upward on bottom frame member 15 because of the relative placement of the members in forming the main frame of the enclosure (FIG. 2).

Horizontal frame members 14 and 15 may have a plurality of grooves 36 formed on front surfaces of web walls 38 which add to the decorative aspect of the enclosure (FIG . 6). Each frame member 14 and 15 also includes a pair of spaced longitudinal ribs 37 on the rear surface thereof which strengthen the frame members.

Figures 7, 8, 9, 10, 11, 12:
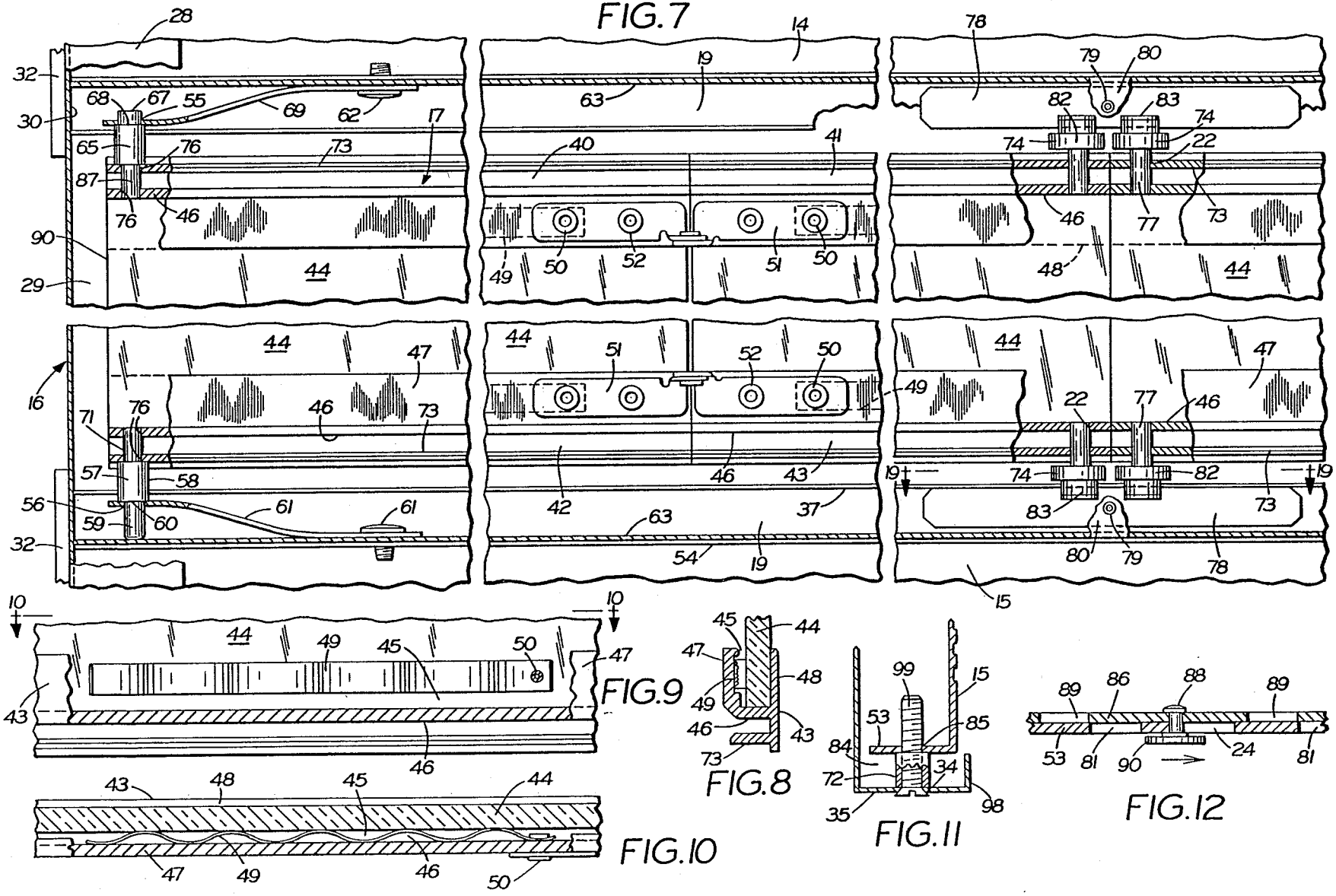
FIG. 7 is a fragmentary rear elevational view of the fireplace enclosure with portions broken away and in section, showing portions of the doors and mounting devices associated therewith.
FIG. 8 is an enlarged fragmentary sectional view taken on line 8—8, FIG. 2, showing the bottom door channel member and the glass panel and ribbon spring steel strip mounted therein.
FIG. 9 is a fragmentary rear elevational view of the bottom door channel member with portions broken away and in section showing the glass panel and ribbon spring steel strip therein.
FIG. 10 is a fragmentary top plan view of the bottom door channel member with portions broken away and in section, looking in the direction of arrows 10—10, FIG. 9.
FIG. 11 is a greatly enlarged fragmentary sectional view taken on line 11—11, FIG. 1 showing the horizontal bottom frame member and its engagement with the bottom support strip.
FIG. 12 is a fragmentary diagrammatic view showing the operation of the draft diverter plate and its attachment to and cooperation with the horizontal bottom frame member.

Bifold doors 17 each includes top channel members 40 and 41 which are in a parallel spaced relationship to bottom channel members 42 and 43 for mounting a pair of glass panels 44 therebetween (FIGS. 1 and 2). Since the construction, mounting and function of both doors 17 is identical, only one of the pair of doors is described herein. Each of the door channel members includes a channel space 45 defined by a web wall 46 and side walls 47 and 48 (FIGS. 8–10). Glass panel 44 is secured in each channel space 45 by a ribbon spring steel strip 49 which is attached to channel member side wall 47 by a single rivet 50 at one end of the spring strip. Glass panel 44 abuts web wall 46 and is securely clamped against side wall 48 by spring strip 49, preventing the glass panel from slipping out of channel space 45. This arrangement holds glass panels 44 firmly between each pair of mounting channel members while allowing the panels to be installed quickly and easily at the assembly plant. An assembler does not have to contend with the ribbon spring steel strip slipping out of channel space 45 when an attempt is made to place the glass panel 44 therein since the spring strip is secured in the channel space by rivet 50.

The bifold nature of each door 17 is achieved by a pair of hinges 51 (FIG. 7) which attach together top channel members 40 and 41, and bottom members 42 and 43. Hinges 51 are attached to the adjacent channel members by rivets 50 and 52, the former also acting to attach ribbon spring steel strip 49 to wall 47 of each channel member, as described above.

Each door 17 is removably mounted on top and bottom frame members 14 and 15 (FIGS. 2 and 7) by top and bottom hinge pins 65 and 57, respectively. Bottom hinge pin 57 has a stepped configuration including a central portion 58 and upper and lower reduced diameter extensions 71 and 59, respectively. Upper extension 71 passes through a pair of aligned holes 76 formed in wall 73 and web wall 46 of channel member 42, wall 73 being below and in parallel spaced relationship to web wall 46 (FIG. 8). Lower extension 59 is smaller in diameter than central portion 58 forming an annular shoulder 60 therebetween. Extension 59 passes through a hole 56 formed in a bottom spring clip 61 which is attached by a screw 62 to web wall 63 of channel 19 formed in bottom frame member 15. Shoulder 60 of pivot pin 57 abuts spring clip 61 and the end of extension 59 abuts wall 63 to pivotally removably mount door 17 on frame 15. The engagement of extension 59 with wall 63 provides support for the door in combination with the engagement of top hinge pin 65 with top spring clip 69.

Top hinge pin 65 (FIG. 7) also has a stepped configuration including a central portion 66 and upper and lower reduced diameter extensions 67 and 87, respectively. Lower extension 87 passes through a pair of aligned holes 76 formed in wall 73 and web wall 46 of channel member 40, wall 73 being above and in parallel spaced relationship to web wall 46. Upper extension 67 is smaller in diameter than central portion 66 forming an annular shoulder 68 therebetween. Pin extension 67 passes through a hole 55 formed in a top spring clip 69 which is attached by screw 62 to wall 63 of channel 19 formed in top frame member 14. Shoulder 68 abuts spring clip 69 whereby door 17, through the combined engagement of hinge pins 57 and 65 with spring clips 61 and 69, respectively, is pivotally removably mounted on main frame 16. Furthermore, the combination of short upper extension 67 of top hinge pin 65 relative to longer lower extension 59 of bottom hinge pin 57 and the increased flexibility of top spring clip 69 relative to bottom spring clip 61 facilitates easy removal and remounting of door 17 for cleaning and repair thereof. The top spring clip is merely forced upward to a point above the end of extension 67 thereby allowing door 17 to be removed from frame 16 by pulling the upper portion of the door outward and then lifting pin 57 out of spring clip 61.

Figure 19:
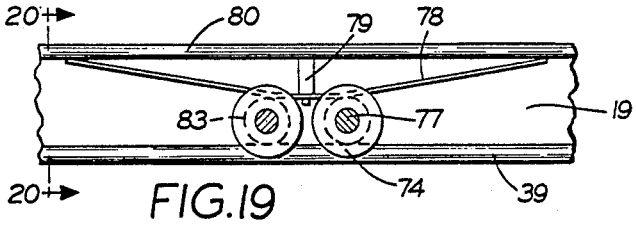
FIG. 19 is an enlarged fragmentary sectional view taken on line 19—19, FIG. 7, showing the engagement of the rollers with a top edge of the bottom frame member and the V-shaped spring clip.
Figure 20:
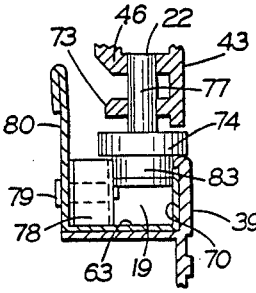
FIG. 20 is an enlarged sectional view taken on line 20—20, FIG. 19.

Bifold doors 17 are slidably supported on frame 16 by a pair of guide rollers 74 (FIGS. 2 and 7) formed of a low-friction material such as sold under the trademark TEFLON. Rollers 74 each have a stepped configuration including a central portion 82 and reduced diameter extensions 77 and 83. The guide rollers 74 are mounted on frame members 41 and 43 of each bifold door 17 by extension 77 which passes through a pair of aligned holes 22 formed in wall 73 and web wall 46 of channel members 41 and 43. Wall 73 lies above web wall 46 on channel member 41 and below web wall 46 on channel member 43 because of the relative placement of the channel members. The low-friction material of rollers 74 assists in slidably opening and closing doors 17 by movement of rollers 74 in channel 19 of frame members 14 and 15. The bottom rollers 74, which are mounted on channel member 43 of each door 17, additionally function to support the doors in main frame 16 (FIGS. 19 and 20). A shoulder of each bottom roller 74, formed by central portion 82 and reduced diameter extension 83, rests on and slides along the top edge of extension 39 of bottom frame member 15 to provide the support as shown particularly in FIGS. 19 and 20.

A handle 75 (FIGS. 1 and 2) is mounted on each channel member 41 for manually slidably opening and closing doors 17. As each door 17 is moved to the fully closed position as shown in FIGS. 1, 7, 19 and 20, the upper and lower guide rollers 74 operatively engage a pair of V-shaped spring clips 78 which are attached by rivets 79 to wall 80 of each frame member 14 and 15.

More specifically, extension 83 of each guide roller 74 engages V-shaped spring clip 78 as the door is moved to the fully closed position, in which position roller extension 83 is clamped between the spring clip and wall 80 of frame members 14 and 15 to secure the bifold door in the closed position and to assist in the support thereof.

A draft diverter plate 86 (FIGS. 2 and 12) may be incorporated into bottom frame member 15 to provide air passages to the firebox to regulate the airflow to a fire therein. The diverter plate is attached to horizontal bottom wall 53 of bottom frame member 15 by a fastener 88 which extends through diverter plate 86 and through a slot 24 formed in wall 53. A frontwardly extending tab 90 is attached to a bottom end of fastener 88. A plurality of openings 89 are formed in plate 86 and align with complementary-shaped openings 81 formed in wall 53 upon sliding movement of plate 86 along wall 53 by manual actuation of tab 90 for the selective aligning of openings 89 with openings 81. Openings 89 and 81 may be positioned in total alignment whereby maximum air flow into the firebox is achieved, or in he alternative, openings 89 may be partially aligned with openings 81 thereby reducing the air flow to the firebox, or in total nonalignment at which position air flow is blocked.

Figure 13:
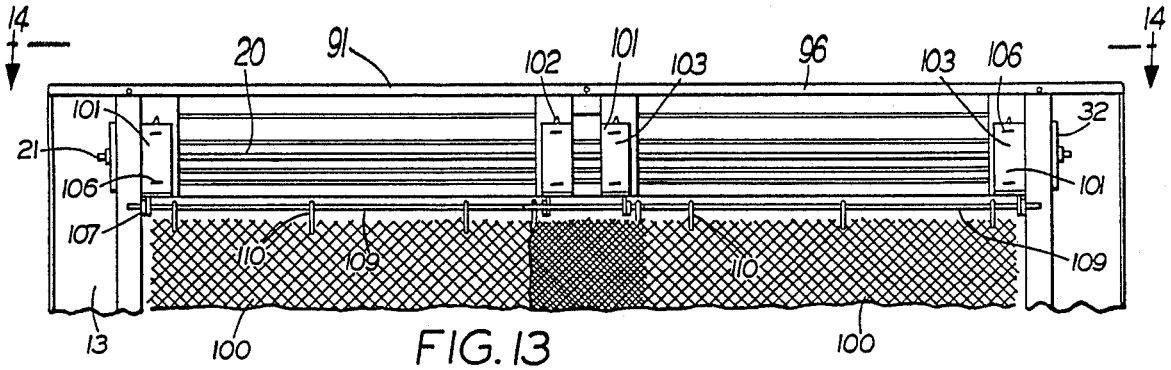
FIG. 13 is an enlarged fragmentary rear elevational view of the enclosure with the doors removed, particularly showing the mesh curtain assembly.
Figure 15:
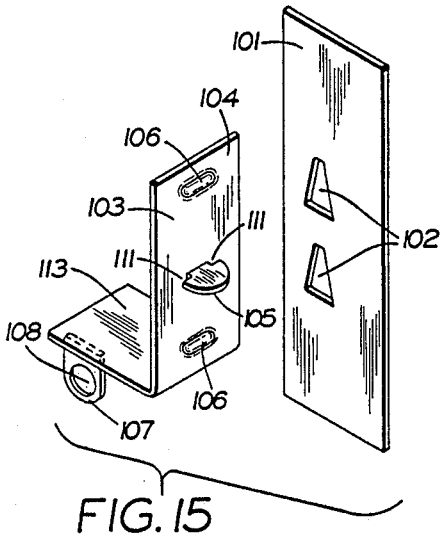
FIG. 15 is an enlarged perspective view of the curtain rod holder and mounting plate for the mesh curtain.
Figure 17:
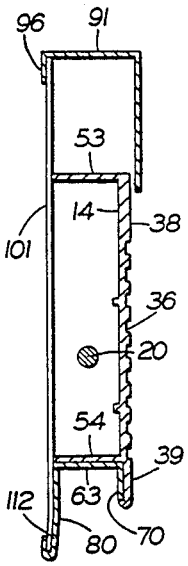
FIG. 17 is an enlarged sectional view taken on line 17—17, FIG. 16, showing the mounting plate engaged with the top frame member and decorative strip.
Figure 18:
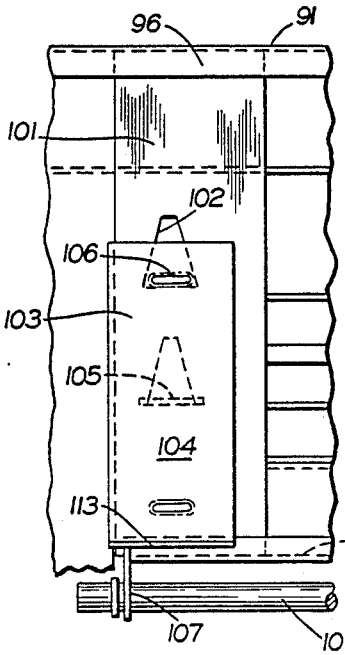
FIG. 18 is a view similar to FIG. 16 showing the curtain rod holder in locking engagement with the mounting plate and supporting a curtain rod thereon.

A pair of heavy gauge metal mesh curtains 100 (FIG. 13), which prevent sparks from leaving the firebox of a fireplace when doors 17 are in the open position, may be mounted on the rear of main frame 16 to cover access opening 18 of enclosure 12. Four rectangular, elongated mounting plates 101 (FIG. 15) are mounted on the rear of top frame member 1, two of the plates being mounted adjacent the outer ends thereof and the two other plates being mounted adjacent each other near the middle of the top frame member (FIG. 13). The lower transverse end of each plate 101 is force-fitted into a slot 112 formed by wall 80 of top frame member 14, wall 80 being bent back upon itself to form slot 112. The upper transverse end of each plate 101 is secured by the cooperation of a flange 96 of a decorative top strip 91 and the rear edge of wall 53 of the top frame member which prevent rearward and forward movement, respectively, of the plates (FIGS. 16–18).

A pair of vertically spaced triangular-shaped openings 102 are formed in the center portion of each plate 101 for mounting a curtain rod holder 103 (FIG. 15) thereon. Curtain rod holder 103 includes an L-shaped bracket 104, the vertical portion of the bracket having a key 105 projecting outwardly from the center thereof for mounting holder 103 on plate 101. Each holder 103 further includes a pair of vertically spaced knobs 106 protruding from the top and bottom ends thereof in the same direction as the key for locking holder 103 in position when mounted on plate 101. Horizontal leg 113 of L-shaped bracket 104 includes a lug 107 projecting downwardly therefrom and having an opening 108 formed therein whereby a pair of curtain rods 109 are supported by curtain rod holders 103, as particularly shown in FIGS. 13 and 18. A plurality of ring-like hangers 110 slidably suspend curtains 100 from rods 109.

Figure 16:
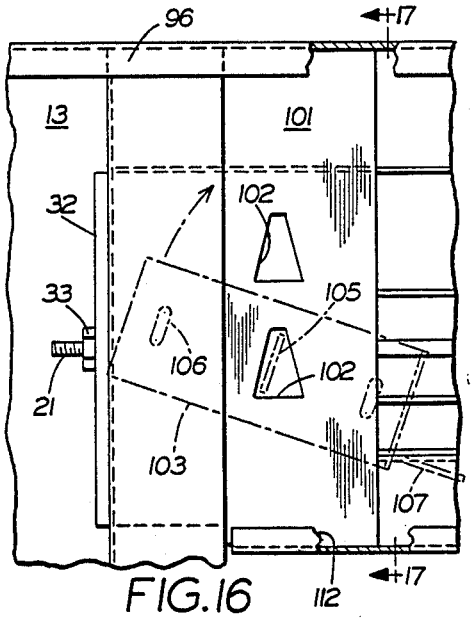
FIG. 16 is an enlarged fragmentary rear elevational view with portions broken away and in section, showing the curtain rod holder in dot dash lines and its engagement with the mounting plate.

Key 105 of each curtain rod holder 103 is preferably inserted into bottom opening 102 of the appropriate mounting plate 101 in the manner shown in FIG. 16. As key 105 of holder 103 is inserted into bottom opening 102 and rotated in the direction of the dot-dash arrow in FIG. 16, a pair of undercuts 111 in key 105 engage mounting plate 101 adjacent bottom opening 102 thereby preventing forward and rearward movement of holder 103 (FIG. 18). Upper knob 106 of bracket 104 engages top opening 102 locking holder 103 in place and preventing rotation of the holder and accidental disengagement thereof from plate 101.

Figure 14:
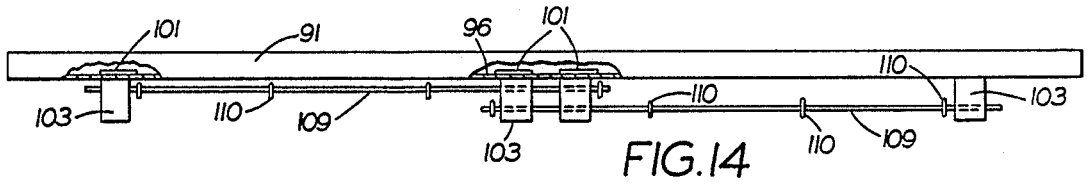
FIG. 14 is an enlarged top plan view of the enclosure with portions broken away and in section looking in the direction of arrows 14—14, FIG. 13.

As shown particulary in FIGS. 13 and 14, the lugs of the left-handed outside and right-hand center holders 103 are in alignment with each other, with the right-hand center holder being positioned more rearwardly than its left-hand outside counterpart and the aligned right-hand outside and left hand center holders 103. One rod 109 passes through and is supported by the left-hand outside and right-hand center holders 103 and the second rod passes through and is supported by the other pair of holders 103. This arrangement provides for overlap of the curtains when the curtains are slidably moved to the closed position, hangers 111 assisting in the slideable movement of curtains 100 along rods 109.

Although key 105 of each older 103 preferably is inserted into bottom opening 102 of its corresponding mounting plate 101, the key also may be inserted into top opening 102 with lower knob 106 lockingly engaging bottom opening 102. This provides for vertical adjustment in the mounting of curtain rod holders 103 enabling the installation of different length curtains 100 on enclosure 12.

Decorative top strip 91 (FIGS. 1–5) preferably fits over and conceals the exposed top ends of vertical side frame members 13 and the top portion of horizontal frame member 14 to provide a finished, attractive appearance to the enclosure. Top strip 91 is attached to frame member 14 by an L shaped bracket 92 (FIG. 5). A rivet 93 passes through a flange 96 of strip 91 and through bracket 92 and another rivet 94 passes through the bracket and through wall 53 of frame member 14 thereby securing the decorative strip to the top frame member. Additionally, a pair of spacers 95 (FIGS. 3 and 4) assist in maintaining a constant spaced relationship between flange 96 of strip 91 and side wall 28 of side frame members 13 and also to provide an additional means of attachment for strip 91 to main frame 16. Rivets 97 attach flange 96 to spacers 95 and wall 28 of the side members.

A bottom support strip 98 (FIGS. 1, 2 and 11) fits over and conceals the exposed bottom ends of vertical side frame members 13 and the bottom portion of horizontal frame member 15, further adding to the finished, attractive appearance of the enclosure and providing additional support and sturdiness thereto. Bottom strip 98 is mounted on bottom frame member 15 by four screws 99 which pass through holes 34 formed in wall 35 of strip 98 and through aligned holes 85 formed in wall 53. Collars 72 are mounted on screws 99 to support frame member 15 in a spaced relationship from bottom strip 98 to provide an air flow space 84 therebetween. Space 84 also allows air to pass to the firebox of the fireplace as does diverter plate 86.

The aforedescribed enclosure requires only three different extrusion dies. One die forms the main frame members 13; a second die forms top and bottom frame members 14 and 15; and a third die forms strips 91 and 98. Also, only one additional extrusion die is needed to form all of the door channel members. The main frame of the enclosure is assembled by cutting the extruded metal pieces to specified lengths depending on the desired size of enclosure 12. The main frame is then quickly and easily assembled by clamping the side frame members against the top and bottom frame members afterwich the tie rods are inserted into the appropriate holes in the side members and nuts 33 are placed on the threaded ends of the tie rods to provide the aforesaid clamping action of the side members against the top and bottom members. The decorative top strip and the bottom support strip then are attached to the main frame as descried above. The glass panels are quickly and easily slid into the channel spaces formed in the channel members between the ribbon spring steel strip and opposite wall. Each door then is mounted on the main frame by inserting the hinge pins in the appropriate holes in the spring clip and frame members.

When the bifold doors are slidably moved to the closed position, the outermost vertical edge 90 of the outermost glass panel of each door is concealed within channel 29 of the side frame members (FIGS. 2 and 7). Furthermore, each bifold door is designed to move beyond center at the hinges thereby assisting in maintaining the doors in the closed position.

Although the various frame members including those of the doors are formed by extruding they also may be formed by roll mill forming or by sheet metal stamping and subsequent folding. Likewise, these frame members may be formed of steel, brass, aluminum and similar metals.

Accordingly, the improved fireplace construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved fireplace enclosure is constructed and used, the characteristics of the construction, and the advantageous, new and useful results obtained; the new and useful structures, devices, elements, arrangements, parts, and combinations, are set forth in the appended claims.

What is claimed is:

1. An improved fireplace enclosure for mounting within an opening of a fireplace including:

(a) a generally rectangular frame formed by a pair of spaced horizontal top and bottom members and a pair of spaced vertical side members providing an opening therebetween for access into the fireplace, said bottom frame member including a separate generally U-shaped channel and having a V-shaped spring clip mounted within said channel, said top frame member having a V-shaped spring clip mounted thereon, and at least one of said horizontal frame members having mounting spring clips mounted thereon;

(b) a pair of bifold doors movably mounted on the frame for opening and closing the frame opening, said doors each comprising a frame formed by spaced horizontal top and bottom channel members, said channel members having glass panels mounted therebetween by ribbon spring steel strips attached at one end to a sidewall of each of the channel members, said bifold doors each having hinge pins mounted thereon for operatively engaging the mounting spring clips to removably pivotally mount the doors on the rectangular frame, said door frame members having guide rollers formed of a low friction material mounted thereon, said guide rollers each having a shoulder formed thereon, so that the shoulders of certain of the guide rollers slide on a top edge of the bottom frame member to assist in slideably moving the doors between open and closed positions, to provide support therefor and to operatively engage the v-shaped spring clips when the doors are moved to the closed position for securing said doors in said closed position;

(c) a pair of spaced rods extending between a certain pair of the frame members for drawing said certain pair into clamping engagement with the other pair of said frame members for securing together the frame members to form the rectangular frame for subsequent mounting within the fireplace opening; and (d) a metal mesh curtain assembly mounted on the rectangular frame, said curtain assembly including a plurality of horizontally spaced mounting plates mounted on the top frame member, said plates each having a pair of spaced triangular-shaped openings formed therein, a curtain rod holder mounted on each of the mounting plates and having a key and a pair of knobs formed thereon, said key being engageable in one of the triangular-shaped mounting plate openings and one of the knobs being engageable in the other of said triangular-shaped openings for removably mounting the holder on the mounting plate, lug means formed on each of the rod holders for supporting a curtain rod extending between a pair of said holders, and a mesh curtain suspended from each of the curtain rods for blocking the emission of sparks from the fireplace through the access opening of the rectangular frame.

2. The fireplace enclosure defined in claim 1 in which the frame members are formed of extruded metal.

3. The fireplace enclosure defined in claim 2 in which the frame members have an anodized, mar resistant finish.

4. The fireplace enclosure defined in claim 1 in which the spaced rods extend parallel to and are located rearwardly adjacent the horizontal frame members.

5. The fireplace enclosure defined in claim 4 in which the rods each have threaded ends which extend through openings formed in the side frame members; and in which nuts are engaged with the threaded rod ends whereby said side frame members are clamped against the top and bottom members to form the rectangular frame.

6. The fireplace enclosure defined in claim 1 in which the door frame members are formed of extruded metal.

7. The fireplace enclosure defined in claim 6 in which the door frame members have an anodized, mar resistant finish.

8. The fireplace enclosure defined in claim 1 in which a draft diverter plate provided with a plurality of spaced openings, is mounted on the bottom frame member; and in which said diverter plate openings are selectively alignable with complementary-shaped openings formed in the bottom frame member to provide air passages through the frame whereby air may pass through said passages and into the fireplace when said openings are in alignment.

9. The fireplace enclosure defined in claim 1 in which the door means is mounted in a spaced relationship with respect to the bottom frame member providing an opening therebetween whereby air may pass through said opening and into the fireplace.

10. The fireplace enclosure defined in claim 1 in which a decorative strip formed of extruded metal and having an anodized, mar resistant finish is mounted on the top member.

11. The fireplace enclosure defined in claim 1 in which a support strip is mounted on the bottom member in spaced relationship thereto by fastening means having collars thereabout providing for said spaced relationship.

12. An improved fireplace enclosure having a frame forming an access opening and a metal mesh curtain assembly, said curtain assembly including:

(a) a plurality of horizontally spaced mounting plates mounted on an upper rear surface of the frame, said mounting plates each having two triangular-shaped openings formed therein;

(b) a curtain rod holder mounted on each of said mounting plates, each of said holders having an outwardly projecting key and a pair of knobs formed thereon, so that the key is selectively engageable in one of the triangular-shaped openings and one of the knobs is engageable in the other of said openings for locking the holder in position on the mounting plate;

(c) lug means formed on the curtain rod holders for supporting at least one curtain rod therefrom; and (d) mesh curtain slideably mounted on each of the rods by a plurality of hangers, said curtains being slidably movable to cover the access opening to prevent the emission of sparks from the fireplace through said access opening.

* * * * *